US005993506A

United States Patent [19]

Kobayashi et al.

[11] Patent Number: 5,993,506

[45] Date of Patent: Nov. 30, 1999

[54] PLATE-CRYSTALLINE TUNGSTEN CARBIDE-CONTAINING HARD ALLOY, COMPOSITION FOR FORMING PLATE-CRYSTALLINE TUNGSTEN CARBIDE AND PROCESS FOR PREPARING SAID HARD ALLOY

[75] Inventors: Masaki Kobayashi; Kozo Kitamura; Satoshi Kinoshita, all of Kawasaki, Japan

[73] Assignee: Toshiba Tungaloy Co., Ltd., Kawasaki, Japan

[21] Appl. No.: 08/977,628

[22] Filed: Nov. 25, 1997

Related U.S. Application Data

[63] Continuation of application No. 08/470,002, Jun. 6, 1995, abandoned.

[51] Int. Cl.[6] ..... C22C 29/08

[52] U.S. Cl. ..... 75/240; 428/552; 428/553; 419/15; 419/18; 419/38; 419/57; 419/60

[58] Field of Search ..... 428/539.5, 548, 428/551, 552, 565, 567, 568, 697, 698, 699, 627, 533; 75/230, 236, 237, 238, 240, 241, 244, 246, 248, 255, 252; 419/15, 18, 38, 57, 60; 264/674

[56] References Cited

U.S. PATENT DOCUMENTS

| | | | |
|---|---|---|---|
| 3,071,489 | 1/1963 | Pelton et al. | 117/22 |
| 3,480,410 | 11/1969 | Hummer | 29/182.7 |
| 3,647,401 | 3/1972 | Meadows | 29/182.8 |
| 3,660,050 | 5/1972 | Iler et al. | 29/182.8 |
| 3,779,745 | 12/1973 | Rudy | 75/176 |
| 3,779,746 | 12/1973 | Rudy | 75/176 |
| 4,013,460 | 3/1977 | Brown et al. | 75/204 |
| 4,162,392 | 7/1979 | Brown et al. | 219/146.51 |
| 4,236,926 | 12/1980 | Lindholm et al. | 75/238 |
| 4,963,183 | 10/1990 | Hong | 75/241 |
| 5,580,666 | 12/1996 | Dubensky et al. | 428/552 |

OTHER PUBLICATIONS

Grant, Julius, ed., *Hackh's Chemical Dictionary*, 1969, p. 623.

*Primary Examiner*—Kathryn Gorgos
*Assistant Examiner*—Thomas H Parsons
*Attorney, Agent, or Firm*—Foley & Lardner

[57] ABSTRACT

Disclosed are a plate-crystalline tungsten carbide-containing hard alloy which comprises 4 to 40% by volume of a binder phase containing at least one of iron group metals selected from Co, Ni and Fe as a main component; and the balance of a hard phase comprising tungsten carbide alone, or tungsten carbide and 50% by volume or less of a compound with a cubic structure selected from at least one of carbide and nitride of the 4a (Ti, Zr and Hf), 5a (V, Nb and Ta) or 6a (Cr, Mo and W) group element of the periodic table and mutual solid solutions thereof, and inevitable impurities, wherein when peak intensities at a (001) face and a (101) face in X-ray diffraction using Kα rays with Cu being a target are represented by h(001) and h(101), respectively, the tungsten carbide satisfies h(001)/h(101) ≧0.50, a composition for forming a plate-crystalline tungsten carbide, and a process for preparing the plate-crystalline tungsten carbide-containing hard alloy.

13 Claims, No Drawings

PLATE-CRYSTALLINE TUNGSTEN CARBIDE-CONTAINING HARD ALLOY, COMPOSITION FOR FORMING PLATE-CRYSTALLINE TUNGSTEN CARBIDE AND PROCESS FOR PREPARING SAID HARD ALLOY

This application is a continuation, of application Ser. No. 08/470,002, filed Jun. 6, 1995 (now abandoned).

BACKGROUND OF THE INVENTION

This invention relates to a hard alloy having excellent hardness, toughness, wear resistance, fracture resistance, plastic deformation resistance and thermal cracking resistance, in which plate-crystalline tungsten carbide (hereinafter abbreviated to "platy WC") is crystallized, specifically to a platy WC-containing hard alloy suitable as cutting tools such as an insert, a drill and an end mill, a base material of a coating super hard tool, plastic working tools such as a drawing mold, a die mold and a forging mold and shearing tools such as a punching mold and a slitter, a composition for forming platy WC and a process for preparing the platy WC-containing hard alloy.

In general, hardness, i.e., wear resistance and strength and toughness, i.e., fracture resistance of a hard alloy can be changed by a particle size of WC, a Co content and an addition amount of other carbide so that the hard alloy can be widely used for various purposes. However, there is a problem of antinomy tendency that if wear resistance is heightened, fracture resistance is lowered, while if fracture resistance is heightened, wear resistance is lowered.

As one course for solving this problem, there may be mentioned a means obtained by paying attention to anisotropy of mechanical characteristics due to crystal faces of WC, specifically, for example, a means relating to a hard alloy in which platy WC exists, which platy WC has a shape represented by a triangle plate or a hexagonal plate and has a (001) face preferentially grown in the direction of the (001) face since the (001) face of WC crystal shows the highest hardness and the direction of a (100) face shows the highest elastic modulus, or a process for preparing the same.

As representative examples of prior art techniques relating to platy WC, there may be mentioned Japanese Patent Publications No. 23049/1972 and No. 23050/1972 and Japanese Provisional Patent Publications No. 34008/1982, No. 47239/1990, No. 51408/1990, No. 138434/1990, No. 274827/1990 and No. 339659/1993.

Among the prior art techniques relating to platy WC, in Japanese Patent Publications No. 23049/1972 and No. 23050/1972, there has been described a process for preparing a platy WC-containing hard alloy by using mixed powder which comprises colloidal tungsten carbide powder containing a porous agglomerate for growing platy WC and powder of Fe, Ni, Co or an alloy thereof.

In Japanese Provisional Patent Publication No. 34008/1982, there has been described a process for preparing twin tungsten carbide in which (001) faces are bonded as a twin face by adding a small amount of an iron group metal salt to mixed powder of strongly pulverized W and C and then carbonizing the mixture under heating.

Further, in Japanese Provisional Patent Publications No. 47239/1990 and No. 138434/1990, there has been described a process for preparing a hard alloy by using, as a starting material, a solid solution of (W,Ti,Ta)C in which tungsten carbide is contained in a super-saturated state and crystallizing platy WC at the time of sintering under heating.

Next, in Japanese Provisional Patent Publication No. 274827/1990, there has been described a process for preparing an anisotropic hard alloy by subjecting a used hard alloy to oxidation, reduction and then carbonization to obtain powder, molding the powder and then subjecting the resulting molded compact to sintering or hot pressing.

In addition, in Japanese Provisional Patent Publication No. 339659/1993, there has been described a process for preparing a hard alloy containing platy WC by subjecting mixed powder comprising WC with a size of 0.5 $\mu$m or less, 3 to 40% by weight of a compound with a cubic structure and 1 to 25% by weight of Co and/or Ni to sintering at 1,450° C. or higher.

In the hard alloys or the hard alloys obtained by the preparation processes described in these 8 publications, the growing rate of the (001) crystal face of WC is low, all of the a axis length, c axis length and c/a ratio of the WC crystal are small and the ratio of platy WC contained is low, whereby there is a problem that all of various characteristics of the hard alloy, particularly hardness, wear resistance, strength, toughness and fracture resistance cannot be improved. Also, in the preparation processes, there are problems that it is difficult to control a particle size, it is difficult to heighten the ratio of platy WC contained, said processes can be applied only to a hard alloy in which compositional components are limited, and preparation cost is high.

SUMMARY OF THE INVENTION

The present invention has solved the problems as described above, and an object of the present invention is to provide a platy WC-containing hard alloy exhibiting a synergistic effect by high hardness, high toughness and high strength that hardness is high, wear resistance is excellent, toughness is high and also fracture resistance is excellent, which cannot be considered in a conventional hard alloy, and achieving a long lifetime by heightening all of the growing rate of a WC (001) crystal face, the a axis length, c axis length and c/a ratio of WC (001) crystal and the ratio of platy WC crystal contained, and to provide a process for preparing the same, by which platy WC can be easily incorporated into a hard alloy by sintering under heating mixed powder of platy WC-forming powder comprising composite carbide containing an iron group metal, W and C or a precursor thereof and carbon powder.

The present inventors have studied for many years in order to improve strength, toughness and fracture resistance of a hard alloy without lowering hardness and wear resistance thereof, and consequently found that such an object can be achieved by heightening all of the growing rate of a WC (001) crystal face, the a axis length, c axis length and c/a ratio of WC (001) crystal and the ratio of platy WC crystal contained. In order to obtain such a hard alloy, by adding carbon powder to composite carbide comprising an iron group metal, W and C or powder of a precursor which forms this composite carbide during heating and then heating the mixture, platy WC satisfying the characteristics described above can be easily formed by reaction and crystallization, to accomplish the present invention.

That is, the platy WC-containing hard alloy of the present invention is a hard alloy which comprises 4 to 40% by volume of a binder phase containing at least one of iron group metals ((cobalt (Co), nickel (Ni) and iron (Fe)) as a main component; and the balance of a hard phase comprising tungsten carbide, or tungsten carbide containing 50% by volume or less of a compound with a cubic structure selected from at least one of carbide and nitride of the 4a (titanium (Ti), zirconium (Zr) and hafnium (Hf)), 5a (vanadium (V), niobium (Nb) and tantalum (Ta)) or 6a (chromium (Cr), molybdenum (Mo) and tungsten (W)) group element of the periodic table and mutual solid solutions thereof, and inevitable impurities, wherein when peak intensities at a (001) face and a (101) face in X-ray diffraction using Kα rays with Cu being a target are represented by h(001) and h(101), respectively, said tungsten carbide satisfies h(001)/h(101) ≧0.50, and the platy WC-containing hard alloy of the present invention has three features described below.

DESCRIPTION OF THE PREFERRED EMBODIMENTS

In the following, the present invention is explained in detail.

As the binder phase of the platy WC-containing hard alloy of the present invention, there may be specifically mentioned, for example, Co, Ni, Fe, and alloys such as Co—Ni, Co—W, Ni—Cr and Fe—Ni—Cr. If the amount of the binder phase is less than 4% by volume, sintering becomes difficult so that cavities remain in an inner portion, or the rate of forming platy WC crystal is lowered so that strength and hardness are lowered remarkably. On the other hand, if the amount exceeds 40% by volume, the amount of WC including plate crystal is relatively decreased so that hardness and wear resistance are lowered remarkably.

As the compound with a cubic structure in the platy WC-containing hard alloy of the present invention, there may be specifically mentioned, for example, TaC, NbC, $V_4C_3$, VC, (W,Ti)C, (W,Ti,Ta)C, TiN, ZrN, (W,Ti)(C,N) and (W,Nb,Zr)CN. If the amount of the compound with a cubic structure exceeds 50% by volume, the amount of WC including platy WC is relatively decreased so that hardness and toughness are lowered remarkably.

In the first preferred embodiment of the present invention, the platy WC-containing hard alloy comprises 4 to 40% by volume of the binder phase containing at least one of iron group metals (Co, Ni and Fe) as a main component; and the balance of WC, wherein when peak intensities at a (001) face and a (101) face in X-ray diffraction using Cu-Kα rays are represented by h(001) and h(101), respectively, said WC satisfies h(001)/h(101) ≧0.50. If the peak intensity ratio of h(001)/h(101) is less than 0.50, the growing rate of the WC (001) crystal face showing the highest hardness is low, whereby improvement of hardness is small. The peak intensity ratio of h(001)/h(101) is preferably 0.55 or more, particularly preferably 0.60 or more.

In the second preferred embodiment of the present invention, the platy WC-containing hard alloy has a feature that the WC crystal has an a axis length of 0.2907 nm or more and a c axis length of 0.2840 nm or more. If the a axis length is less than 0.2907 nm or the c axis length is less than 0.2840 nm, inner distortion of a WC crystal lattice is small, whereby an effect of increasing hardness is small. Further, the platy WC-containing hard alloy of the present invention has a feature that the ratio of the c axis length to the a axis length of the crystalline axis, i.e., the c/a ratio is particularly preferably 0.9770 or more.

In the third preferred embodiment of the present invention, the platy WC-containing hard alloy has a feature that the (001) face of the WC crystal is oriented in parallel to a pressurized face in a molding step to exhibit orientation property. That is, when the peak intensities at the (001) face and the (101) face of the WC crystal by X-ray diffractometry of a face p parallel to said pressurized face and a face h perpendicular thereto are represented by p(001), p(101), h(001) and h(101), respectively, p(001)/p(101) <1.2 × h(001)/h(101) is satisfied. If this relative peak intensity ratio does not satisfy the above formula, the orientation rate of the WC (001) face in a specific direction is decreased to lower anisotropy of hardness, which is not suitably used for exhibiting properties by improving hardness in a specific direction or face.

In the platy WC-containing hard alloy described above, it is preferred that 20% by volume or more of platy WC having a ratio of the maximum length to the minimum length of a WC particle in a sectional structure of the WC particle being 3.0 or more is contained, whereby all of various characteristics such as hardness, wear resistance, strength, toughness and fracture resistance are improved. It is particularly preferred depending on the case that the average particle size of WC is 0.5 μm or less. Platy WC in the sectional structure of the hard alloy is contained preferably in an amount of 40% by volume or more, particularly preferably 50% by volume or more.

The composition for forming platy WC to be used for preparing the platy WC-containing hard alloy of the present invention comprises composite carbide containing 60 to 90% by weight of W, 0.5 to 3.0% by weight of carbon and the balance of at least one of iron group metals, whereby a hard alloy having a high content of platy WC can be obtained. As said composite carbide, there may be specifically mentioned, for example, $Co_3W_9C_4$, $Co_2W_4C$, $Co_3W_3C$, $Co_6W_6C$, $Ni_2W_4C$, $Fe_2W_4C$, $Fe_3W_3C$, $Fe_4W_2C$ and mutual solid solutions thereof.

The process for preparing the platy WC-containing hard alloy of the present invention comprises molding mixed powder of platy WC-forming powder comprising composite carbide comprising an iron group metal, W and C and/or a precursor thereof, carbon powder and, if necessary, cubic compound-forming powder, and then sintering the molded compact under heating at 1,200 to 1,600° C. under vacuum or non-oxidizing atmosphere. The process of the present invention is carried out under the same conditions as in a conventional process for preparing a hard alloy, for example, for a sintering-maintaining time of 30 to 90 minutes under atmosphere of a non-oxidizing gas such as an inert gas or hydrogen gas under reduced pressure, normal pressure or pressurization.

The composite carbide in the process for preparing the platy WC-containing hard alloy of the present invention is the same as the composite carbide described above. Further, there may be mentioned those in which 20% by weight or less of the 4a, 5a or 6a group metal (excluding W) of the periodic table is dissolved in the above composite carbide such as $Co_3(W,Ti)_9C_4$, $Co_2(W,V)_4C$, $Co_3(W,Ta)_3C$, $(Ni,Cr)_2W_4C$ and $(Fe,Mo)_3W_3C$. The dissolved 4a, 5a or 6a group metal is preferred in some cases since it has an action of controlling the size, shape and distribution of crystallized platy WC particles simultaneously with forming carbide by sintering under heating.

As the precursor of the composite carbide in the process for preparing the platy WC-containing hard alloy of the present invention, there may be specifically mentioned a W alloy containing an iron group metal, a mixture of W and/or $W_2C$ and an iron group metal and a mixture of WC, oxide of the 4a, 5a or 6a group metal of the periodic table and an iron group metal. There may be more specifically mentioned, for example, powder of an alloy of W-10% by weight of Co, mixed powder of $W_2C$-10% by weight of Co, mixed powder of WC-10% by weight of $TiO_2$-10% by weight of Co and mixed powder of W-10% by weight of WC-2% by weight of $Cr_2O_3$-10% by weight of Ni, each of which reacts with a part of carbon powder added during sintering under heating to form the above composite carbide.

As the carbon source compound in the process for preparing the platy WC-containing hard alloy of the present invention, there may be specifically mentioned graphite, thermal carbon, petroleum pitch and a thermosetting resin. Particularly when powder of the precursor of the above composite carbide is used, it is preferred to use graphite having an average particle size of 2 to 20 $\mu$m since formation of platy WC is accelerated to increase hardness and toughness. The amount of carbon may be any amount so long as it is an amount sufficient for reducing residual oxygen in mixed powder by sintering under heating and capable of forming a platy WC with a W component, and also it is such an amount that the composite carbide does not remain or free carbon is not precipitated in the hard alloy obtained by sintering.

In the process for preparing the platy WC-containing hard alloy of the present invention, as the cubic compound-forming powder to be added, if necessary, there may be specifically mentioned, for example, TaC, NbC, $V_4C_3$, VC, TiC, (W,Ti)C, (W,Ti,Ta)C, TiN, ZrN and Ti(CN).

It is preferred that the sintering under heating in the process for preparing the platy WC-containing hard alloy of the present invention includes a first stage of forming composite carbide represented by $M_{3-X}W_{3+X}C$ (where M represents an iron group metal and $0 \leqq X \leqq 1$) and a second stage of forming platy WC from said composite carbide since formation of platy WC is accelerated to increase hardness and toughness.

In the process for preparing the platy WC-containing hard alloy of the present invention, it is preferred that W alloy powder and/or metal W powder is/are contained as the above precursor since the WC (001) face in the hard alloy obtained is oriented in a specific direction to improve anisotropy of hardness. That is, the flat faces of the W alloy powder and/or metal W powder which are made flat by mixing and pulverization are oriented in parallel to a pressurized face in the molding step so that the (001) face of WC formed by sintering under heating is oriented in parallel to the pressurized face.

The platy WC-containing hard alloy of the present invention has an action of improving hardness, strength, toughness and fracture resistance of an alloy simultaneously by the growing rate of a WC (001) crystal face, the a axis length, c axis length and c/a ratio of WC (001) crystal and the ratio of platy WC crystal contained, and the process for preparing the same has an action of forming platy WC and a binder phase by reacting composite carbide comprising an iron group metal, W and C with carbon.

EXAMPLES

The present invention is described in detail by referring to Examples.

Example 1

First, the respective powders of commercially available W having average particle sizes of 0.5 $\mu$m, 1.5 $\mu$m and 3.2 $\mu$m (shown as "W/F", "W/M" and "W/L", respectively, in the following tables), carbon black with a size of 0.02 $\mu$m (shown as "C" in the tables) and Co, Ni, Fe, Cr, $Cr_3C_2$ and $TaH_2$ with a size of 1 to 2 $\mu$m were weighed in accordance with the formulation compositions shown in Table 1 and charged into pots made of stainless steel together with an acetone solvent and balls made of a hard alloy. The powders were mixed and pulverized for 24 hours and then dried to prepare mixed powders. The mixed powders were charged into graphite crucibles and heated under vacuum where atmospheric pressure was about 10 Pa for 1 hour at temperatures shown in Table 1 to prepare composition powders P(1) to P(6) of the present invention and precursors P(7) and P(8) for preparing composition powders of the present invention. After these powders were fixed by X-ray diffraction, compositions and components were quantitated by the internal addition method. The results are shown in Table 1.

Next, the composition powders in Table 1 and the respective powders of the above W, C, Co, Ni, Fe, Cr and $Cr_3C_2$, commercially available WC having average particle sizes of 0.5 $\mu$m, 1.5 $\mu$m and 3.2 $\mu$m (shown as "WC/F", "WC/M" and "WC/L", respectively, in the tables), $W_2C$ with a size of 1.4 $\mu$m, graphite with a size of 6.0 $\mu$m (shown as "G" in the tables), $WO_3$ with a size of 0.4 $\mu$m, $TiO_2$ with a size of 0.03 $\mu$m and a (W,Ti,Ta)C solid solution (WC/TiC/TaC=50/20/30 in terms of weight ratio, shown as "WTT" in the tables) with a size of 1.5 $\mu$m were weighed in accordance with the formulation compositions shown in Table 2 and charged into pots made of stainless steel together with an acetone solvent and balls made of a hard alloy. The powders were mixed and pulverized for 48 hours and then dried to prepare mixed powders. The mixed powders were charged into metal molds and pressurized under a pressure of 2 ton/cm$^2$ to prepare green compact molds each having a size of about 5.5×9.5×29 mm. The green compact molds were placed on sheets comprising alumina and carbon fiber, heated under vacuum where atmospheric pressure was about 10 Pa and maintained for 1 hour at temperatures shown in Table 2 to obtain hard alloys of Present samples 1 to 17 and Comparative samples 1 to 17.

The hard alloy samples thus obtained were subjected to wet grinding processing using #230 diamond grinding stone to prepare samples each having a size of 4.0×8.0×25.0 mm. Each flexural strength (strength resistant to bending) was measured (by a method corresponding to Japanese Industrial Standard B4104 which is similar to ISO 242, 2804). Further, after one face (parallel to a pressurized face) of each sample was subjected to lapping with 1 $\mu$m of diamond paste, Vickers hardness and a fracture toughness value Klc were measured with a load of 198 N (by the so-called IM method in which measurement is carried out by measuring length of cracks formed from an edge of dent by using a Vickers hardness tester). A structure photograph of the face subjected to lapping was taken by an electron microscope. By an image processor, the average particle size of WC and the volume ratio of platy WC having a ratio of the maximum size to the minimum size of 3.0 or more to the whole WC were determined. Further, the ratio of the peak intensity at the (001) face of WC to the peak intensity at the (101) face of WC in X-ray diffraction using Cu-K$\alpha$ rays, and the lattice constant (a axis length, c axis length) and c/a ratio of the WC crystal were measured. The results are shown in Table 3.

Also, approximate compositions measured by the structure photographs described above are shown in Table 2.

TABLE 1

| Sample No. | Formulation composition (% by weight) | Heating temperature (° C.) | Composition (% by weight) |
|---|---|---|---|
| Present sample P(1) | 88.4W/M-9.1Co-2.5C | 1,300 | $90Co_3W_9C_4$-$5Co_2W_4C$-5WC |
| Present sample P(2) | 85.5W/F-13.1Co-1.4C | 1,100 | $90Co_2W_4C$-$5Co_6W_6C$-5WC |
| Present sample P(3) | 87.6W/M-8.0Ni-2.0$Cr_3C_2$-2.4C | 1,300 | $100(Ni,Cr)_2W_4C$ |
| Present sample P (4) | 75.3W/M-23.1Co-1.6C | 1,300 | $90Co_3W_3C$-$5Co_2W_4C$-5WC |
| Present sample P(5) | 75.0W/M-23.4Fe-1.6C | 1,200 | $90Fe_3W_3C$-$5Fe_4W_2C$-5WC |
| Present Sample P(6) | 86.5W/M-9.0Co-2.0$TaH_2$-2.5C | 1,300 | $95Co_3(W,Ta)_9C_4$-10WC |
| Sample P(7) | 90.0W/L-10.0Co | 1,400 | 65W-$35W_6Co_7$ |
| Sample P(8) | 88.0W/F-2.0Cr-10.0Ni | 1,100 | 85(W—Cr)-$15WNi_4$ |

TABLE 2

| Sample No. | Formulation composition (% by weight) | Sintering temperature (° C.) | Synthetic composition (% by weight) |
|---|---|---|---|
| Present sample 1 | 96.8P(1)-3.2C | 1,400 | 85.5WC-14.5Co |
| Present sample 2 | 96.0P(2)-1.0$Cr_3C_2$-3.0C | 1,380 | 78.5WC-21.5(Co—Cr) |
| Present sample 3 | 97.1P(3)-2.9C | 1,420 | 84.5WC-15.5(Ni—Cr) |
| Present sample 4 | 96.8P(4)-3.2C | 1,380 | 66.5WC-33.5Co |
| Present sample 5 | 96.7P(5)-3.3C | 1,360 | 64WC-36Fe |
| Present sample 6 | 94.4P(7)-5.6G | 1,400 | 84.5WC-15.5$C_6$ |
| Present sample 7 | 94.8P(8)-5.2G | 1,420 | 82WC-18(Ni—Cr) |
| Present sample 8 | 67.1$W_2C$-30.0P(1)-2.9C | 1,480 | 95.5WC-4.5Co |
| Present sample 9 | 59.2$W_2C$-30.0W/M-7.0Co-3.8C | 1,420 | 88.5WC-11.5Co |
| Present sample 10 | 81.0WC/M-10.0$WO_3$-6.8Co-2.2Gr | 1,420 | 88.5WC-11.5Co |
| Present sample 11 | 83.4$W_2C$-7.0Fe-5.0Ni-2.0$Cr_3C_2$-2.6C | 1,420 | 77WC-23(Fe—Ni—Cr) |
| Present sample 12 | 96.8P(6)-3.2G | 1,400 | 83.5WC-2TaC-14.5Co |
| Present sample 13 | 66.0P(1)-28.9$W_2C$-2.0TaC-3.1C | 1,440 | 88WC-2TaC-10Co |
| Present sample 14 | 77.5P(1)-20.0WTT-2.5C | 1,400 | 63WC-26(W,Ti,Ta)C-11Co |
| Present sample 15 | 68.5W/M-20.0WTT-7.0Co-4.5G | 1,400 | 63WC-26(W,Ti,Ta)C-11Co |
| Present sample 16 | 79.8WC/M-5.4$TiO_2$-6.1TaC-7.1Co-1.7G | 1,400 | 63WC-26(W,Ti,Ta)C-11Co |
| Present sample 17 | 58.1P(4)-40.0WTT-1.9C | 1,440 | 37WC-45(W,Ti,Ta)C-18Co |
| Comparative sample 1 | 91.2WC/M-8.8Co | 1,400 | 85.5WC-14.5Co |
| Comparative sample 2 | 86.5WC/F-1.0$Cr_3C_2$-12.7Co | 1,380 | 78.5WC-21.5(Co—Cr) |
| Comparative sample 3 | 90.3WC/M-7.8Ni-1.9$Cr_3C_2$ | 1,420 | 84.5WC-15.5(Ni—Cr) |
| Comparative sample 4 | 77.6WC/M-22.4Co | 1,380 | 66.5WC-33.5Co |
| Comparative sample 5 | 77.4WC/M-22.6Fe | 1,360 | 64WC-36Fe |
| Comparative sample 6 | 90.5WC/L-9.5Co | 1,400 | 84.5WC-15.5Co |
| Comparative sample 7 | 88.6WC/F-1.8$Cr_3C_2$-9.6Ni | 1,420 | 82WC-18(Ni—Cr) |
| Comparative sample 8 | 97.3WC/M-2.7Co | 1,480 | 95.5WC-4.5Co |
| Comparative sample 9 | 93.0WC/M-7.0Co | 1,420 | 88.5WC-11.5Co |
| Comparative sample 10 | 86.0WC/M-7.0Fe-5.0Ni-2.0$Cr_3C_2$ | 1,420 | 77WC-23 (Fe—Ni—Cr) |
| Comparative sample 11 | 89.2WC/M-2.1TaC-8.7Co | 1,400 | 83.5WC-2TaC-14.5Co |
| Comparative sample 12 | 92.0WC/M-2.0TaC-6.0Co | 1,440 | 88WC-2TaC-10Co |
| Comparative sample 13 | 73.0WC/M-20.0WTT-7.0Co | 1,400 | 63WC-26(W,Ti,Ta)C-11Co |
| Comparative sample 14 | 46.6WC/M-40.0WTT-13.4Co | 1,440 | 37WC-45(W,Ti,Ta)C-18Co |
| Comparative sample 15 | 76.9$W_2C$-20.0P(1)-3.1C | 1,520 | 97WC-3Co |
| Comparative sample 16 | 72.7P(7)-23.0Co-4.3G | 1,360 | 57WC-43Co |
| Comparative sample 17 | 51.3P(4)-47.0WTT-1.7C | 1,440 | 31WC-53(W,Ti,Ta)C-16Co |

TABLE 3

| Sample No. | Flexural strength (GPa) | Hardness HV20 | Fracture toughness value K1C ($MPa \cdot m^{1/2}$) | Average particle size of WC ($\mu m$) | Ratio of platy WC (% by (volume) | Ratio of WC crystal faces 001/101 | WC lattice constant (nm) a axis | WC lattice constant (nm) c axis | Axial ratio c/a |
|---|---|---|---|---|---|---|---|---|---|
| Present sample 1 | 2.7 | 1,750 | 10.3 | 1.5 | about 70 | 0.65 | 0.29084 | 0.28412 | 0.9776 |
| Present sample 2 | 3.6 | 1,590 | 13.6 | 0.3 | about 80 | 0.69 | 0.29082 | 0.28422 | 0.9778 |
| Present sample 3 | 2.8 | 1,700 | 10.9 | 1.5 | about 60 | 0.63 | 0.29085 | 0.28419 | 0.9776 |
| Present sample 4 | 3.5 | 1,270 | — | 1.6 | about 80 | 0.75 | 0.29084 | 0.28418 | 0.9776 |
| Present sample 5 | 2.6 | 1,380 | 14.3 | 1.4 | about 40 | 0.62 | 0.29086 | 0.28415 | 0.9773 |

TABLE 3-continued

| Sample No. | Flexural strength (GPa) | Hardness HV20 | Fracture toughness value K1C (MPa · $m^{1/2}$) | Average particle size of WC (μm) | Ratio of platy WC (% by volume) | Ratio of WC crystal faces 001/101 | WC lattice constant (nm) a axis | WC lattice constant (nm) c axis | Axial ratio c/a |
|---|---|---|---|---|---|---|---|---|---|
| Present sample 6 | 3.1 | 1,370 | 15.5 | 3.2 | about 60 | 0.71 | 0.29082 | 0.28415 | 0.9777 |
| Present sample 7 | 2.8 | 1,620 | 11.1 | 0.4 | about 70 | 0.74 | 0.29085 | 0.28421 | 0.9779 |
| Present sample 8 | 1.7 | 2,110 | 7.8 | 1.8 | about 40 | 0.65 | 0.29084 | 0.28420 | 0.9775 |
| Present sample 9 | 2.9 | 1,890 | 9.8 | 1.3 | about 60 | 0.67 | 0.29082 | 0.28414 | 0.9774 |
| Present sample 10 | 2.7 | 1,870 | 9.7 | 1.4 | about 50 | 0.59 | 0.29084 | 0.28412 | 0.9776 |
| Present sample 11 | 2.6 | 1,610 | 12.6 | 1.6 | about 60 | 0.67 | 0.29085 | 0.28419 | 0.9776 |
| Present sample 12 | 2.6 | 1,780 | 10.0 | 1.4 | about 70 | 0.60 | 0.29082 | 0.28415 | 0.9777 |
| Present sample 13 | 2.4 | 1,950 | 8.9 | 1.4 | about 50 | 0.62 | 0.29086 | 0.28415 | 0.9773 |
| Present sample 14 | 2.2 | 1,890 | 8.5 | 1.5 | about 60 | 0.68 | 0.29082 | 0.28422 | 0.9778 |
| Present sample 15 | 2.4 | 1,900 | 8.6 | 1.4 | about 70 | 0.75 | 0.29084 | 0.28420 | 0.9775 |
| Present sample 16 | 2.0 | 1,870 | 8.7 | 1.4 | about 50 | 0.56 | 0.29084 | 0.28412 | 0.9776 |
| Present sample 17 | 2.2 | 1,540 | 10.7 | 1.6 | about 70 | 0.65 | 0.29082 | 0.28414 | 0.9774 |
| Comparative sample 1 | 2.5 | 1,650 | 9.4 | 1.5 | about 0 | 0.35 | 0.29063 | 0.28378 | 0.9764 |
| Comparative sample 2 | 3.3 | 1,470 | 11.2 | 0.3 | about 0 | 0.30 | 0.29061 | 0.28377 | 0.9765 |
| Comparative sample 3 | 2.6 | 1,640 | 10.1 | 1.4 | about 0 | 0.32 | 0.29065 | 0.28382 | 0.9765 |
| Comparative sample 4 | 2.1 | 1,180 | — | 1.5 | about 0 | 0.35 | 0.29070 | 0.28390 | 0.9765 |
| Comparative sample 5 | 2.7 | 1,300 | 12.9 | 1.5 | about 0 | 0.32 | 0.29066 | 0.28382 | 0.9765 |
| Comparative sample 6 | 2.9 | 1,270 | 14.5 | 3.1 | about 0 | 0.31 | 0.29067 | 0.28385 | 0.9764 |
| Comparative sample 7 | 2.6 | 1,540 | 10.1 | 0.3 | about 5 | 0.36 | 0.29062 | 0.28378 | 0.9767 |
| Comparative sample 8 | 1.8 | 2,090 | 7.1 | 1.9 | about 5 | 0.42 | 0.29060 | 0.28376 | 0.9766 |
| Comparative sample 9 | 2.7 | 1,800 | 8.9 | 1.4 | about 0 | 0.33 | 0.29062 | 0.28377 | 0.9767 |
| Comparative sample 10 | 2.3 | 1,520 | 8.9 | 1.5 | about 0 | 0.31 | 0.29061 | 0.28374 | 0.9764 |
| Comparative sample 11 | 2.5 | 1,700 | 9.0 | 1.3 | about 0 | 0.33 | 0.29066 | 0.28382 | 0.9765 |
| Comparative sample 12 | 2.2 | 1,830 | 8.0 | 1.5 | about 0 | 0.36 | 0.29061 | 0.28377 | 0.9765 |
| Comparative sample 13 | 2.0 | 1,810 | 7.8 | 1.5 | about 0 | 0.30 | 0.29065 | 0.28382 | 0.9765 |
| Comparative sample 14 | 2.0 | 1,470 | 9.7 | 1.5 | about 0 | 0.33 | 0.29062 | 0.28378 | 0.9767 |
| Comparative sample 15 | 1.2 | 2,010 | 6.8 | 2.0 | about 40 | 0.60 | 0.29063 | 0.28378 | 0.9764 |
| Comparative sample 16 | 2.9 | 1,070 | — | 1.6 | about 70 | 0.71 | 0.29060 | 0.28376 | 0.9766 |
| Comparative sample 17 | 1.7 | 1,640 | 8.7 | 1.5 | about 60 | 0.67 | 0.29069 | 0.28390 | 0.9765 |

Example 2

Green compact molds of Present samples 1, 6, 7, 9, 10, 11, 15 and 16 and Comparative samples 1, 6, 7, 9, 10 and 13 used in Example 1 were heated by the same method and under the same conditions as in Example 1, maintained at the respective temperatures of 950° C. and 1,100° C. for 5 minutes, cooled and then taken out. As to the heated compact molds, approximate compositions thereof were determined by the internal addition method by X-ray diffraction. The results are shown in Table 4.

TABLE 4

| Sample No. | Compositional component during sintering under heating (% by weight) 950° C. | 1,100° C. |
|---|---|---|
| Present sample 1 | 35WC-25$Co_3W_9C_4$-20$Co_3W_3C$-20$Co_6W_6C$ | 75WC-20$Co_3W_3C$-5Co |
| Present sample 6 | 30WC-30(W—CO)-20$Co_3W_3C$-20$Co_6W_6C$ | 60WC-40$Co_3W_3C$ |
| Present sample 7 | 70$Ni_2W_4C$-20(W—Cr)-10WC | 55WC-40$Ni_2W_4C$-5(Ni—Cr) |
| Present sample 9 | 40$W_2C$-30$Co_3W_3C$-20WC-10$Co_6W_6C$ | 80WC-15$Co_3W_3C$-5Co |
| Present sample 10 | 40W-20WC-20$Co_3W_3C$-20$Co_6W_6C$ | 70WC-30$Co_3W_3C$ |
| Present sample 11 | 50$(Fe,Ni,Cr)_3W_3C$-30WC-20$Fe_4W_2C$ | 80WC-20$Fe_3W_3C$-10(Fe—Ni—Cr) |
| Present sample 15 | 30WC-30$Co_3W_3C$-20W-20(W,Ti,Ta)C | 65WC-20(W,Ti,Ta)C-10$Co_3W_3C$-5Co |
| Present sample 16 | 50WC-20$Co_3W_3C$-10$Co_6W_6C$-10(Ti,Ta)C | 55WC-30$Co_3W_3C$-15(W,Ti,Ta)C |
| Comparative sample 1 | 91WC-9Co | 91WC-9Co |
| Comparative sample 6 | 90WC-10Co | 90WC-10Co |
| Comparative sample 7 | 90WC-10(Ni—Cr) | 90WC-10(Ni—Cr) |
| Comparative sample 9 | 93WC-7Co | 93WC-7Co |
| Comparative sample 10 | 86WC-14(Fe—Ni—Cr) | 86WC-14(Fe—Ni—Cr) |
| Comparative sample 13 | 73WC-20(W,Ti,Ta)C-7Co | 73WC-20(W,Ti,Ta)C-7Co |

Example 3

Mixed powders of Present samples 6, 7, 9 and 15 and Comparative samples 6, 7, 9 and 13 used in Example 1 were charged into metal molds each having a sectional shape of about 16×16 mm and pressurized under a pressure of 2 ton/$cm^2$ by using upper and lower punches to prepare green compact molds each having a size of about 16×16×6.2 mm. The green compact molds were sintered under heating by the same method and under the same conditions as in Example 1.

The hard alloy samples thus obtained were subjected to wet grinding processing using #230 diamond grinding stone, and one face of the upper and lower faces (shown as "p face" in Table 5) and one face the side faces (shown as "h face" in Table 5) of the samples were subjected to lapping with 1 μm of diamond paste. As to the respective p faces and h faces, the peak intensity ratio of the (001) face to the (101) face of the WC crystal by X-ray diffraction was measured. Further, as to the respective peak intensity ratios obtained, the ratio of the p face to the h face was calculated. The results are shown in Table 5.

TABLE 5

| Sample | Peak intensity ratio | | Face ratio of peak intensity |
|---|---|---|---|
| No. | p face | h face | p/h |
| Present sample 6 | 0.74 | 0.42 | 1.76 |
| Present sample 7 | 0.80 | 0.49 | 1.63 |
| Present sample 9 | 0.67 | 0.44 | 1.52 |
| Present sample 15 | 0.75 | 0.51 | 1.47 |
| Comparative sample 6 | 0.31 | 0.32 | 0.96 |
| Comparative sample 7 | 0.36 | 0.33 | 1.09 |
| Comparative sample 9 | 0.33 | 0.33 | 1.00 |
| Comparative sample 13 | 0.30 | 0.29 | 1.03 |

From the results shown in Tables 3, 4 and 5, it can be seen that the platy WC-containing hard alloys of the present invention exhibit flexural strength, hardness and fracture toughness all of which are higher than those of the comparative hard alloys comprising the same components. As used in the following examples, the designations "FC350", "S48C" and "SKD11" have the following compositions.

| | Components (% by weight) | | | | | | | | | |
|---|---|---|---|---|---|---|---|---|---|---|
| Symbol | C | Si | Mn | P | S | Cr | Mo | V | Cu | Fe |
| SKD11 | 1.40~1.60 | 0.40 or less | 0.60 or less | 0.030 or less | 0.030 or less | 11.00~13.0 | 0.80~1.20 | 0.20~0.50 | — | Remainder |
| S48C | 0.45~0.51 | 0.15~0.35 | 0.60~0.90 | 0.030 or less | 0.035 or less | — | — | — | — | Remainder |
| FC350 | 2.5~4.0 | 0.5~3.0 | 0.3~1.2 | 0.01~0.6 | 0.02~0.12 | 0.1~0.5 | — | — | 0.1~1.0 | Remainder |

Example 4

Mixed powders of Present samples 9 and 13 and Comparative samples 9 and 12 used in Example 1 were charged into metal molds each having a sectional shape of about 16×16 mm and pressurized under a pressure of 2 ton/cm$^2$ by using upper and lower punches to prepare green compact molds each having a size of about 16×16×6.2 mm. The green compact molds were sintered under heating by the same method and under the same conditions as in Example 1 and then subjected to wet grinding processing to obtain chips for cutting of SNGN120408 according to ISO Standard. As to these chips, a lathe turning test was conducted by using molds under the following conditions to measure a life time until a flank wear amount became 0.35 mm. The results are shown in Table 6.

Material to be cut: FC350
Cutting rate: V=100 m/min
Depth of cut: d=1.5 mm
Feed: f=0.3 mm
Processing liquid: dry type

Example 5

Mixed powders of Present samples 12 and 15 and Comparative samples 11 and 13 used in Example 1 were charged into metal molds each having a sectional shape of about 16×16 mm and pressurized under a pressure of 2 ton/cm$^2$ by using upper and lower punches to prepare green compact molds each having a size of about 16×16×6.2 mm. The green compact molds were sintered under heating by the same method and under the same conditions as in Example 1 and then subjected to wet grinding processing to obtain chips for cutting of SNGN120408 according to ISO Standard. These chips were subjected to pre-horning at −30°×0.15 mm and then charged into a CVC coating furnace. The surfaces of the chips were coated successively with 1.0 μm of TiN, 5.0 μm of TiCN, 2.0 μm of TiC, 2.0 μm of $Al_2O_3$ and 1.0 μm TiN (total coating thickness: 11 μm). By using the coated chips obtained, an intermittent lathe turning test was conducted by using steel under the following conditions to measure a life time until a blade tip was broken or a flank wear amount became 0.35 mm. The results are shown in Table 6.

Material to be cut: S48C (with 4 grooves)
Cutting rate: V=150 m/min
Depth of cut: d=2.0 mm
Feed: f=0.25 mm
Processing liquid: dry type

Example 6

Mixed powders of Present sample 2 and Comparative sample 2 used in Example 1 were pressurized under a pressure of about 2 ton/cm$^2$ by using a dry hydrostatic pressure press device to prepare round bar molds each having a diameter of 10 mm and a length of 56 mm. The round bar molds were sintered under heating by the same method and under the same conditions as in Example 1 and then subjected to wet grinding processing to obtain end mills each having a length of 42.0 mm, a blade tip diameter of 6.0 mm, a blade number of 2 and a helix angle of 30°. As to these end mills, a cutting processing test was conducted by using metal mold steel under the following conditions to measure a life time until a flank wear amount became 0.25 mm. The results are shown in Table 6.

Material to be cut: SKD11
Cutting rate: V=45 m/min
Depth of cut: d=6.0 mm
Feed: f=0.02 mm/blade
Width of cut: W=3.5 mm
Processing liquid: wet type (a water-soluble oily agent)

Example 7

Mixed powders of Present samples 3 and 7 and Comparative samples 3 and 7 used in Example 1 were pressurized under a pressure of about 2 ton/cm$^2$ by using a dry hydrostatic pressure press device to prepare cylindrical molds each having an outer diameter of 52 mm, an inner diameter of 12 mm and a height of 40 mm and round bar molds each having a diameter of 14 mm and a length of 40 mm. The cylindrical and round bar molds were sintered under heating by the same method and under the same conditions as in Example 1 and then subjected to wet grinding processing to obtain dies each having an outer diameter of 40.0 mm, an inner diameter of 10.00 mm and a height of 30.0 mm and punches each having a diameter of 9.95 mm and a length of 30.0 mm. By using molds comprising a combination of the die and the punch of the same alloy among the dies and punches obtained, a press molding test was conducted by using powder under the following conditions to measure a life time until flashes were formed on the mold. The results are shown in Table 6.

Powder to be molded: ferrite
Size of mold: diameter: 10.0 mm, thickness: 2.0 mm
Molding time: 1 second
Molding cycle: 5 seconds/mold
Molding pressure: 3 ton/cm$^2$

TABLE 6

| Test item | Sample No. | Life time |
|---|---|---|
| Lathe turning of mold (Example 4) | Present sample 9 | 27 minutes |
| | Present sample 13 | 34 minutes |
| | Comparative sample 9 | 15 minutes |
| | Comparative sample 12 | 20 minutes |
| Intermittent cutting of steel (Example 5) | Present sample 12 | 18 minutes |
| | Present sample 15 | 25 minutes |
| | Comparative sample 11 | 7 minutes (abnormal wear by plastic deformation) |
| | Comparative sample 13 | 12 minutes (chipping wear) |
| Cutting processsing of metal mold steel (Example 6) | Present sample 2 | 25 minutes |
| | Comparative sample 2 | 17 minutes (chipping wear) |
| Press molding (Example 7) | Present sample 3 | 324 hours |
| | Present sample 7 | 517 hours |
| | Comparative sample 3 | 178 hours |
| | Comparative sample 7 | 15 hours (fracture occurred) |

The hard alloy containing platy WC of the present invention has remarkably excellent effects that it has a Vickers hardness of 500 or more at HV20 and a fracture toughness K1c of 0.5 MPa $\cdot m^{1/2}$ or more as compared with a conventional hard alloy having the same composition and particle size, and the process for preparing the same has effects that a hard alloy having a high content of platy WC and a controlled particle size can be prepared easily and inexpensively.

Further, the effect of the hard alloy containing platy WC of the present invention can be expected when a covered hard alloy is prepared by covering the surface of the hard alloy of the present invention with a hard film comprising a single layer or a multilayer of at least one of carbide, nitride, oxycarbide and oxynitride of the 4a (Ti, Zr and Hf), 5a (V, Nb and Ta) or 6a (W, Mo and Cr) group element of the periodic table, oxide and nitride of Al and mutual solid solutions thereof, diamond, diamond-like carbon, cubic boronitride and hard boronitride.

We claim:

1. A plate-crystalline tungsten carbide-containing hard alloy which comprises:

(a) 4 to 40% by volume of a binder phase containing at least one of iron group metals selected from the group consisting of cobalt, nickel and iron as a main component; and (b) the balance of a hard phase comprising (i) tungsten carbide alone, or (ii) tungsten carbide and 50% by volume or less of a compound with a cubic structure selected from at least one of carbide and nitride of the 4a group element of the periodic table selected from the group consisting of titanium, zirconium and hafnium, 5a group element of the periodic table selected from the group consisting of vanadium, niobium and tantalum or 6a group element of the periodic table selected from the group consisting of chromium, molybdenum and tungsten and mutual solid solutions thereof, and inevitable impurities, wherein when peak intensities at a (001) face and a (101) face in X-ray diffraction using K rays with Cu being a target are represented by h(001) and h(101), respectively, said tungsten carbide satisfies h(001)/h(101) $\geqq$0.50.

2. The hard alloy according to claim 1, wherein the tungsten carbide contains 20% by volume or more of plate-crystalline tungsten carbide having a ratio of a maximum length to a minimum length in a sectional structure of the hard alloy of 3.0 or more based on the whole tungsten carbide.

3. The hard alloy according to claim 1, wherein the tungsten carbide has an average particle size of 0.5 $\mu$m or less.

4. The hard alloy according to claim 1, wherein the alloy is shaped into a body, and the (001) crystal face of the plate-crystalline tungsten carbide is oriented in parallel to one face of the polyhedral alloy body.

5. A process for preparing a plate-crystalline tungsten carbide-containing hard alloy as claimed in claim 1, which comprises the steps of:

mixing plate-crystalline tungsten carbide-forming powder comprising a solid solution compound comprising at least one of cobalt, nickel, iron and chromium, tungsten and carbon and/or a precursor thereof, with a carbon source compound of at least one of carbon, graphite and precursors thereof or said carbon source compound and a composition-adjusting compound of at least one of carbide and nitride of the 4a group element of the periodic table selected from the group consisting of titanium, zirconium and hafnium, 5a group element of the periodic table selected from the group consisting of vanadium, niobium and tantalum or 6a group element of the periodic table selected from the group consisting of chromium, molybdenum and tungsten and mutual solid solutions thereof, and metals of cobalt, nickel, iron and chromium and mutual alloys thereof to prepare mixed powder;

molding said mixed powder into a molded compact; and sintering said molded compact under heating at 1,200 to 1,600° C. under vacuum or non-oxidizing atmosphere.

6. The process according to claim 5, wherein the plate-crystalline tungsten carbide-forming powder is at least one selected from the group consisting of a solid solution compound comprising $Co_3W_9C_4$, $Co_2W_4C$, $Co_3W_3C$, $Co_6W_6C$, $Ni_2W_4C$, $Fe_2W_4C$, $Fe_3W_3C$, $Fe_4W_2C$ and mutual solid solutions thereof, tungsten (W), $W_2C$, alloys of at least one of cobalt (Co), nickel (Ni), iron (Fe) and chromium (Cr) with tungsten (W), and a precursor of a solid solution compound comprising oxide of the 4a group element of the periodic table selected from the group consisting of titanium (Ti), zirconium (Zr) and hafnium (Hf), 5a group element of the periodic table selected from the group consisting of vanadium (V), niobium (Nb) and tantalum (Ta) or 6a group element of the periodic table selected from the group consisting of chromium (Cr), molybdenum (Mo) and tungsten (W).

7. A plate-crystalline tungsten carbide-containing hard alloy which comprises:

(a) 4 to 40% by volume of a binder phase containing at least one of iron group metals selected from the group consisting of cobalt, nickel and iron as a main component; and (b) the balance of a hard phase comprising (i) tungsten carbide alone, or (ii) tungsten carbide and 50% by volume or less of a compound with a cubic structure selected from at least one of carbide and nitride of the 4a group element of the periodic table selected from the group consisting of titanium, zirconium and hafnium, 5a group element of the periodic table selected from the group consisting of vanadium, niobium and tantalum or 6a group element of the periodic table selected from the group consisting of chromium, molybdenum and tungsten and mutual solid solutions thereof, and inevitable impurities, wherein said tungsten carbide has an a axis length of 0.2907 nm or more and a c axis length of 0.2840 nm or more in its crystal axis.

8. The hard alloy according to claim 7, wherein the crystal axes of the tungsten carbide have a ratio of the c axis length to the a axis length of 0.9770 or more.

9. The hard alloy according to claim 7, wherein the tungsten carbide contains 20% by volume or more of plate-crystalline tungsten carbide having a ratio of a maximum length to a minimum length in a sectional structure of the hard alloy of 3.0 or more based on the whole tungsten carbide.

10. The hard alloy according to claim 7, wherein the tungsten carbide has an average particle size of 0.5 $\mu$m or less.

11. The hard alloy according to claim 7, wherein the alloy is shaped into a body, and the (001) crystal face of the plate-crystalline tungsten carbide is oriented in parallel to one face of the polyhedral alloy body.

12. A composition for forming a plate-crystalline tungsten carbide, which is a composite composition comprising:

(a) 50% by weight or more of a composite carbide compound, said composite carbide comprises:

(i) at least one of cobalt, nickel, iron and chromium, (ii) tungsten, and (iii) carbon; and the balance of:

(b1) a carbon sources compound of at least one of carbon, graphite and precursors thereof, or (b2) said carbon source compound and a composition adjusting compound of at least one of carbide and nitride of the 4a group element of the periodic table selected from the group consisting of titanium, zirconium and hafnium, 5a group element of the periodic table selected from the group consisting of vanadium, niobium and tantalum or 6a group element of the periodic table selected from the group consisting of chromium, molybdenum and tungsten and mutual solid solutions thereof, and metals of cobalt, iron and chromium and mutual alloys thereof, wherein said composite carbide compound comprises 60 to 90% by weight of tungsten, 0.5 to 3.0% by weight of carbon and the balance of at least one of cobalt, nickel, iron and chromium.

13. The composition according to claim 12, wherein the composite carbide compound is at least one of $Co_3W_9C_4$, $Co_2W_4C$, $Co_3W_3C$, $Co_6W_6C$, $Ni_2W_4C$, $Fe_2W_4C$, $Fe_4W_2C$ and mutual solid solutions thereof.

* * * * *